US006068371A

United States Patent [19]

Wallace et al.

[11] Patent Number: 6,068,371

[45] Date of Patent: May 30, 2000

[54] LIQUID CONTAINMENT AND DISPENSING DEVICE WITH IMPROVED POSITION INDICATING INDICIA

[75] Inventors: J. Kenneth Wallace, Greenwood, Ind.; Susan M. Hmelar, Corvallis, Oreg.; William Contaxis, III, Milford, Conn.

[73] Assignee: Owens-Illinois Closure Inc., Toleod, Ohio

[21] Appl. No.: 08/934,564

[22] Filed: Sep. 22, 1997

[51] Int. Cl.[7] ..... B41J 2/175

[52] U.S. Cl. ..... 347/86

[58] Field of Search ..... 347/85, 86, 87, 347/49

[56] References Cited

U.S. PATENT DOCUMENTS

| | | | |
|---|---|---|---|
| 4,568,954 | 2/1986 | Rosback | 347/86 |
| 5,136,305 | 8/1992 | Wallace et al. | 347/85 |
| 5,519,422 | 5/1996 | Thoman et al. | 347/49 |
| 5,691,755 | 11/1997 | Pawlowski, Jr. et al. | 347/86 |

FOREIGN PATENT DOCUMENTS

| | | |
|---|---|---|
| 0623471A2 | 11/1994 | European Pat. Off. . |
| 0741038A2 | 11/1996 | European Pat. Off. . |
| 0778148A1 | 11/1997 | European Pat. Off. . |

*Primary Examiner*—John Barlow
*Assistant Examiner*—Anh T. N. Vo

[57] ABSTRACT

An ink containment and dispensing device for an ink-jet printer is provided with a main reservoir in the form of a flexible pouch, which is typically maintained at ambient pressure. The main reservoir is coupled to a variable volume chamber via a one-way valve which allows the flow of ink from the reservoir to the chamber and prevents the flow of ink from the chamber to the reservoir. The chamber is coupled to a fluid outlet, which is normally closed to prevent the outward flow of ink. However, when the ink supply is installed in a printer, the fluid outlet establishes a fluid connection between the chamber and the printer. The chamber is part of a pump provided with the ink supply that can be actuated to supply ink from the reservoir to the printer. The pump has a linearly acting pumping member and a flexible diaphragm that overlies the pumping member, the diaphragm being impervious to the transmission of oxygen and moisture therethrough to prevent degradation of the ink within the chamber. The flexible pouch is contained within a rigid, outer shell having an opposed pair of shorter sides interspersed with an opposed pair of longer sides, and the shorter sides of the shell, in the region of the closed end of a cup-shaped shell, are configured for grasping and for identifying the location of the closed end of the shell.

7 Claims, 6 Drawing Sheets

LIQUID CONTAINMENT AND DISPENSING DEVICE WITH IMPROVED POSITION INDICATING INDICIA

CROSS REFERENCE TO RELATED APPLICATION

This application is directed to improvements in the invention of co-pending U.S. patent application Ser. No. 08/429,987.

FIELD OF THE INVENTION

This invention relates to a liquid containment device with a self-contained pump for dispensing liquid in small doses of a predetermined volume. More particularly, this invention relates to a replaceable containment device of the foregoing character which is useful in an ink-jet printer for containing a supply of printing ink and for dispensing the printing ink to a printing head upon the actuation of the self-contained pump.

BACKGROUND AND BRIEF DESCRIPTION OF THE INVENTION

A pending U.S. patent application filed by Bruce Cowger and Norman Pawlowski, Jr., for an invention entitled "Ink Supply For An Ink-Jet Printer," describes an ink supply for an ink-jet printer that is separate from the printer ink pen, and can be replaced upon the emptying of the ink supply without the need to replace the printer ink pen. The ink supply of the aforesaid U.S. patent application incorporates a self-contained pumping device for dispensing ink from a pumping chamber, and describes, as an embodiment of such a pumping device, a bellows pump. However, a bellows pump requires a relatively large extended surface of a semi-rigid material, such as a polymeric material, and is subject to a relatively high rate of oxygen and moisture transfer through the material of the bellows. This oxygen and/or moisture transfer can result in the degradation of the ink within the ink supply, especially in a printer that is used only infrequently. Further, the bellows is subject to leakage at the location of its attachment to another portion of the ink supply. According to the aforesaid pending U.S. patent application Ser. No. 08/429,987, these and other problems associated with the use of a bellows can be avoided by the use of a pumping device having a rigid perimetrical wall, preferably formed integrally with the associated chassis structure of the ink supply, with a linearly acting pumping member that is moveable within a pumping chamber defined by the rigid wall to pressurize ink within the pumping chamber, and a flexible moisture and oxygen barrier film heat sealed to an edge of the perimetrical wall in a continuous pattern and overlying the pumping member.

An ink supply according to the aforesaid U.S. patent application Ser. No. 08/429,987 must be properly oriented before it can be inserted in a docking bay of an ink jet printer in which it is to be used. This is especially important for a replaceable ink supply because replacement ink supply units are likely to be installed by user personnel, who may not be as properly trained in replacement techniques as ink supply manufacturer service personnel. It has now been found that the protective shell and cap of an ink supply can be manufactured with external characteristics that make is easier for user personnel to properly orient a replacement ink supply unit before inserting it in a docking bay of a printer.

Accordingly, it is an object of the present invention to provide an improved liquid containing and dispensing device, and is a corollary an object of the present invention to provide an improved device of the foregoing character that is useful in containing and dispensing ink in an ink-jet printer.

More particularly, it is an object of the present invention to provide a liquid containment and dispensing device with an improved indicia for indicating the correct position of the device during the step of inserting the device in an assembly in which it is to be used and it is a corollary object of the present invention to provide a device of the foregoing character that is useful in containing and dispensing ink in an ink-jet printer.

For a further understanding of the present invention and the objects thereof, attention is directed to the drawing and the following brief description thereof, to the detailed description of the preferred embodiment of the invention, and to the appended claims.

DETAILED DESCRIPTION OF THE PREFERRED EMBODIMENT

Figure 1:
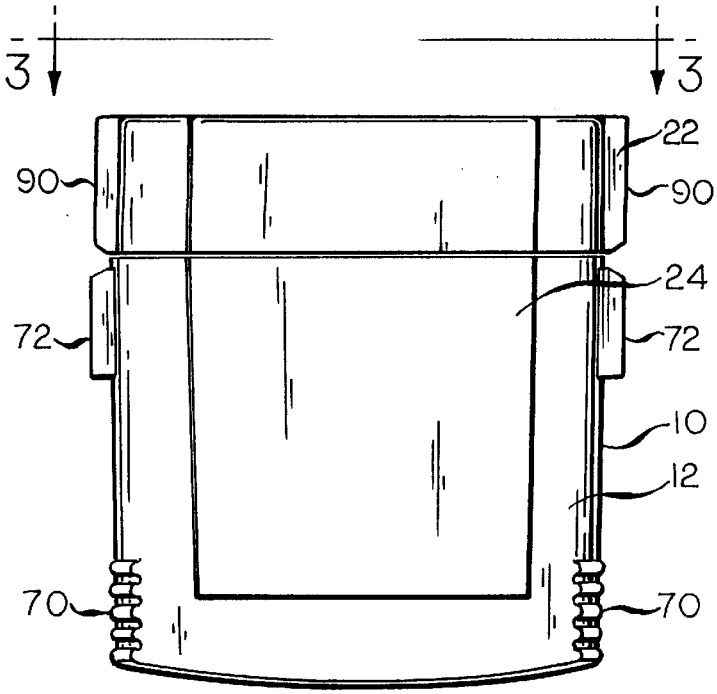
FIG. 1 (PRIOR ART)
FIG. 1 is a side view of a liquid containment and dispensing device according to an embodiment of the present invention.
Figure 2:
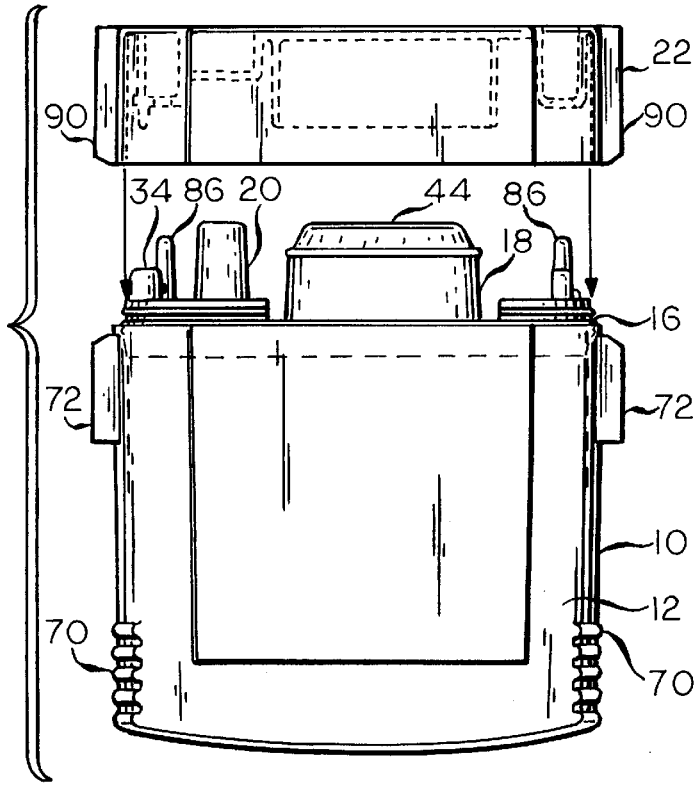
FIG. 2 (PRIOR ART)
FIG. 2 is a an exploded view of the device of FIG. 1.
Figure 3:
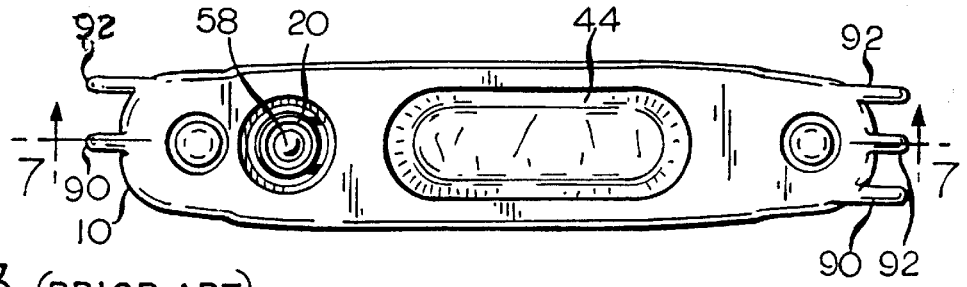
FIG. 3 (PRIOR ART)
FIG. 3 is a plan view of the device of FIGS. 1 and 2 taken on line 3—3 of FIG. 1.
Figure 4:
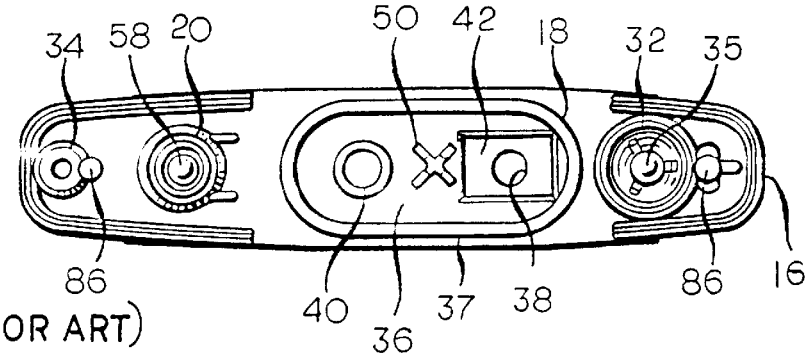
FIG. 4 (PRIOR ART)
FIG. 4 is a plan view of a component of the device of FIGS. 1–3 taken on line 4—4 of FIG. 5.
Figure 5:
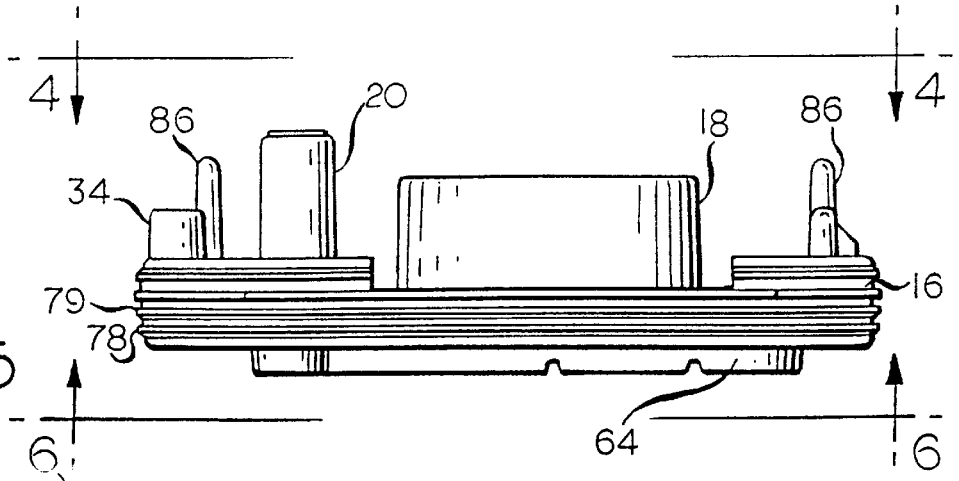
FIG. 5 (PRIOR ART)
FIG. 5 is a side view of the component of FIG. 4.
Figure 6:
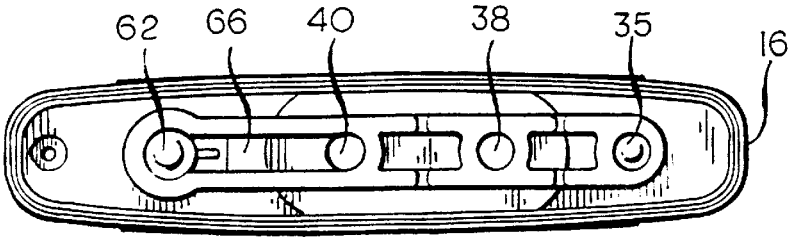
FIG. 6 (PRIOR ART)
FIG. 6 is a plan view of the component of FIGS. 4 and 5 taken on line 6—6 of FIG. 5.
Figure 7:
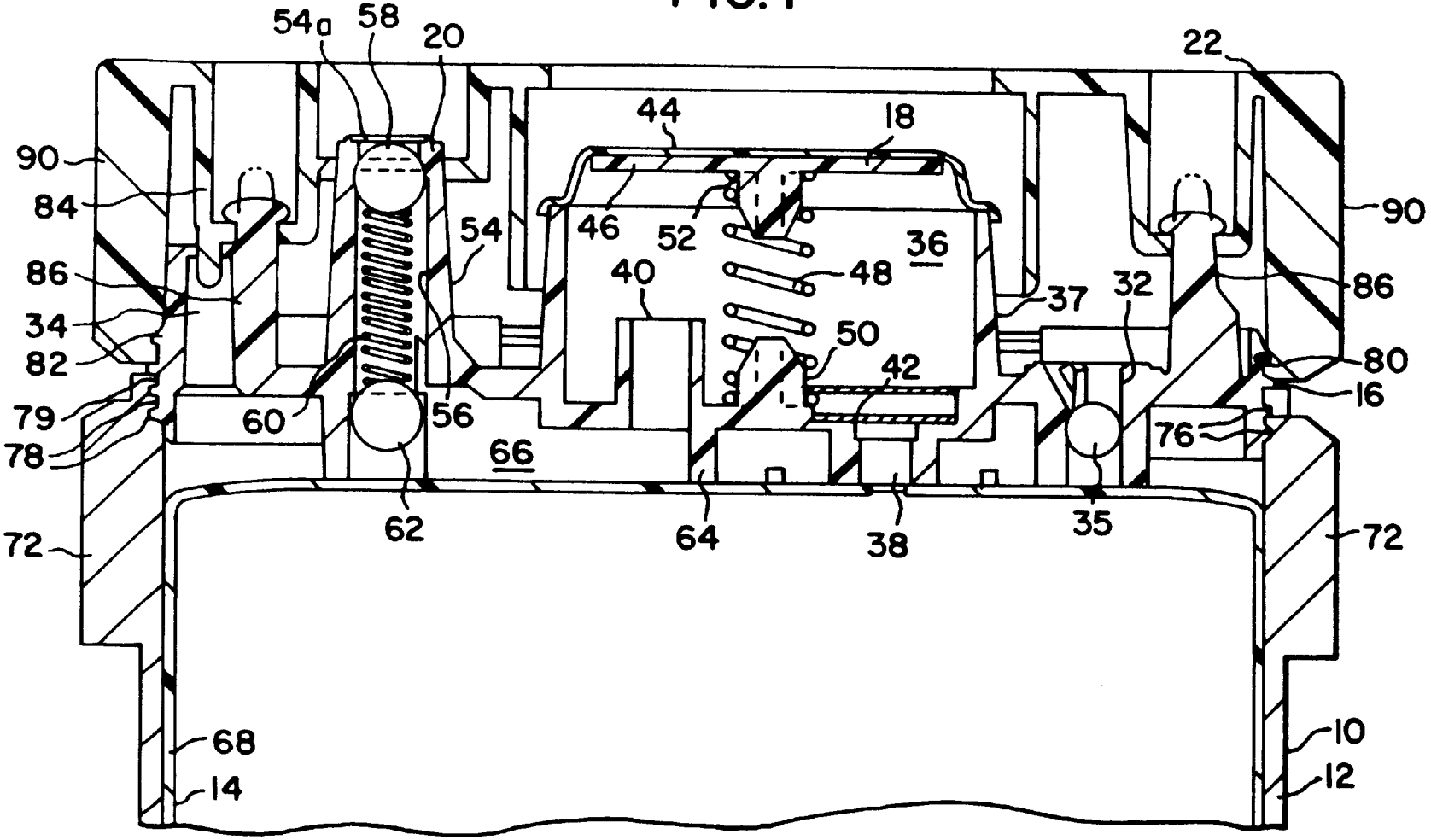
FIG. 7 is a fragmentary sectional view taken on line 7—7 of FIG. 3 and at an enlarged scale.
Figure 8:
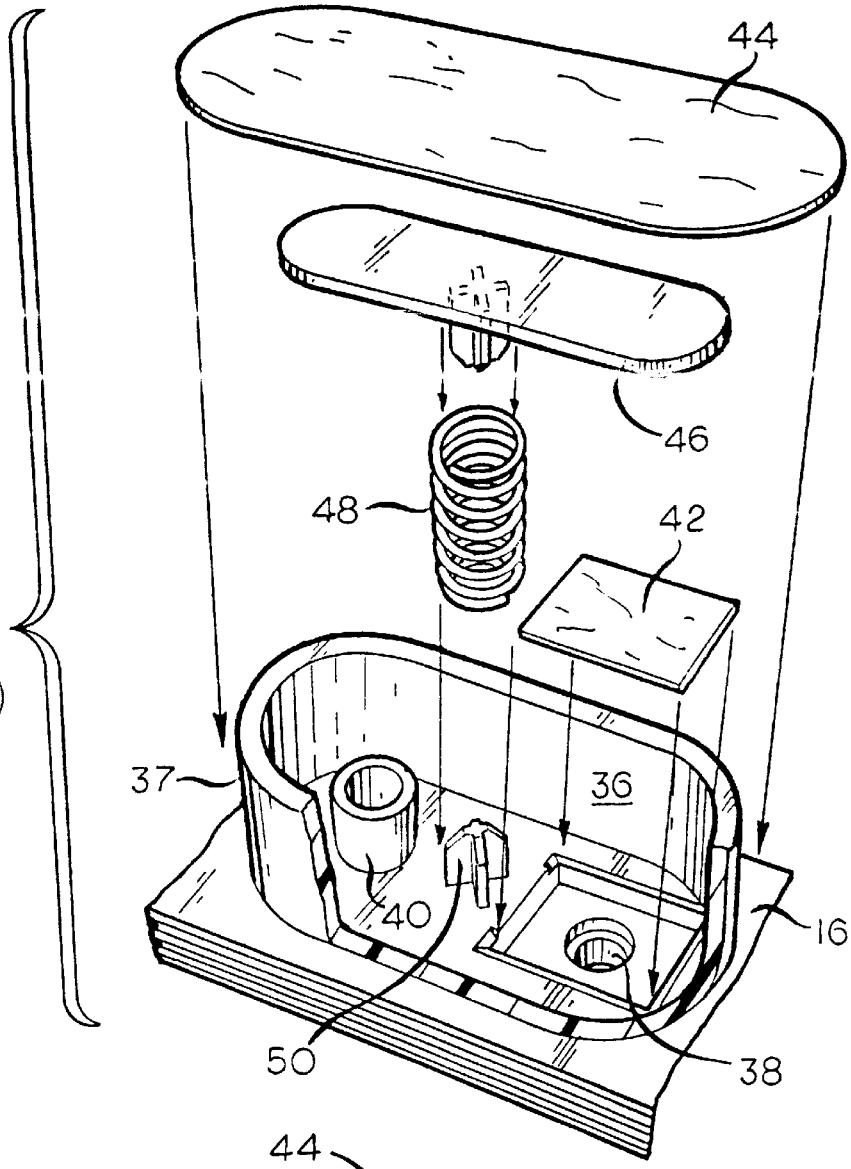
FIG. 8 (PRIOR ART)
FIG. 8 is a fragmentary exploded view of a portion of the device of FIGS. 1–7.
Figure 9:
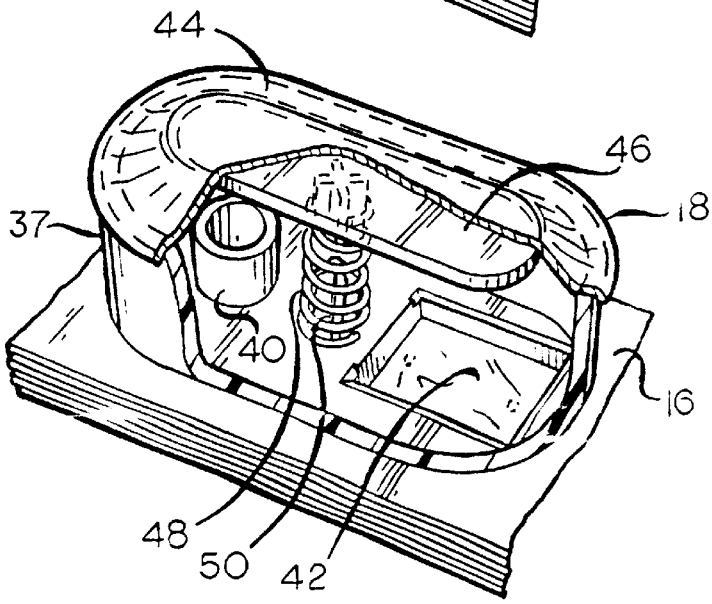
FIG. 9 (PRIOR ART)
FIG. 9 is a fragmentary view similar to FIG. 8 showing the elements of FIG. 8 in assembled relationship to one another.

An ink containment and dispensing device in accordance with an embodiment of the invention described in the aforesaid U.S. patent application Ser. No. 08/429,987 is identified in FIG. 1 by reference numeral 10. The device 10 has a hard protective shell 12 which contains a flexible pouch 14 for containing ink. The shell 12 is attached to a chassis 16, which houses a pump 18 and a fluid outlet 20. A protective cap 22 is attached to the chassis 16 and a label 24 is glued to the outside of the shell 12 and cap 22 elements of the device 10 to secure the shell 12, chassis 16, and cap 22 firmly together. The cap 22 is provided with apertures which allow access to the pump and the fluid outlet.

The device 10 is adapted to be removably inserted into a docking bay (not shown) within an ink-jet printer. When the device 10 is inserted into the printer, a fluid inlet in the docking bay is adapted to engage the fluid outlet 20 to allow ink flow from the device 10 to the printer. An actuator (not shown) in the docking bay is adapted to engage the pump 18. Operation of the actuator causes the pump 18 to provide ink in a series of small doses of a predetermined volume from the flexible pouch 14, through the fluid outlet 20, to the fluid inlet of the docking bay and then to the printer.

The chassis 16 is provided with a fill port 32 at one end and an exhaust port 34 at the other end. Ink can be added to the ink supply through the fill port 32 while air displaced by the added ink is exhausted through the exhaust port 34. After the ink supply is filled, the fill port 32 is sealed with a ball 35 press fit into the fill port 32.

A pumping chamber 36 having an open bottom is formed on the bottom of the chassis 16 within a rigid perimetrical wall 37, which is preferably formed integrally with the chassis 16. As described in more detail below, the chamber 36 can be pressured to supply ink to the printer without pressurizing the interior of the pouch 14. The top of the chamber 36 is provided with an inlet port 38 through which ink may enter the chamber 36 from the pouch 14 by gravity and/or by a negative pressure within the chamber 36. An outlet port 40 through which ink may be expelled from the chamber 36 is also provided.

A one-way flapper valve 42 located at the bottom of the inlet port 38 serves to limit the return of ink from the chamber 36 to the pouch 14. The flapper valve 42 is a rectangular piece of flexible material. In the illustrated embodiment the valve 42 is positioned over the bottom of the inlet port 38 and is heat staked to the chassis 16 at the midpoints of its short sides. When the pressure within the chamber 36 drops below that in the pouch 14, the unstaked sides of the valve 42 each flex to allow the flow of ink through the inlet port 38 and into the chamber 36. By heat staking the valve 42 to the chassis 16 along an opposed pair of sides, less flexing of the valve 42 is required or permitted than would be the case if the valve 42 were staked only along a single side, thereby ensuring that it closes more securely, and this effect is enhanced by doing the heat staking at the midpoints of the shorter sides, as opposed to the longer sides.

In the illustrated embodiment the flapper valve 42 is made of a two ply material. The outer ply is a layer of low density polyethylene 0.0015 inches thick. The inner ply is a layer of polyethylene terephthalate (PET) 0.0005 inches thick. The illustrated flapper valve 42 is approximately 5.5 millimeters wide and 8.7 millimeters long. Such a material is impervious to the flow of ink therethrough when the valve 42 is in its closed position.

The bottom of the chamber 36 is covered with a flexible diaphragm 44. The diaphragm 44 is slightly larger than the opening at the bottom of the chamber and is sealed around the free edge of the perimetrical wall 37 that defines the chamber 36. The excess material in the oversized diaphragm 44 allows the diaphragm to flex up and down to vary the volume of the chamber 36. In the illustrated device, the displacement of the diaphragm 44 allows the volume of the chamber 36 to be varied by about 0.7 cubic centimeters. The fully expanded volume of the illustrated chamber 36 is between about 2.2 and 2.5 cubic centimeters.

In the illustrated embodiment, the diaphragm 44 is made of a multi-ply material having a layer of low density polyethylene 0.0005 inches thick, a layer of adhesive, a layer of metallized polyethylene terephthalate (PET) 0.00048 inches thick, a layer of adhesive, and a layer of low density polyethylene 0.0005 inches thick. Of course, other suitable materials may also be used to form the diaphragm 44. The diaphragm 44 in the illustrated embodiment is heat staked, using conventional methods, to the free edge of the wall 37 of the chamber 36. During the heat staking process, the low density polyethylene in the diaphragm will seal any folds or wrinkles in the diaphragm 44. The diaphragm 44, thus, is impervious to the transmission of oxygen and moisture therethrough, thereby safeguarding the ink in the chamber 36 from degradation by exposure to any such substance.

Within the chamber 36 a pressure plate 46 is positioned adjacent the diaphragm 44, the pressure plate 46 serving as a piston with respect to the chamber 36. A pump spring 48, made of stainless steel in the illustrated embodiment, biases the pressure plate 46 against the diaphragm 44 to urge the diaphragm outward so as to expand the size of the chamber 36. One end of the pump spring 48 is received on a spike 50 formed on the top of the chamber 36 and the other end of the pump spring 48 is received on a spike 52 formed on the pressure plate 46 in order to retain the pump spring 48 in position. The pressure plate 46 in the illustrated embodiment is molded of high density polyethylene.

A hollow cylindrical boss 54 extends downward from the chassis 16 to form the housing of the fluid outlet 20, the boss 54 being formed integrally with the chassis 16. A bore 56 of the hollow boss 54 has a narrow throat **54*a* at its lower end. A sealing ball 58, made of stainless steel in the illustrated embodiment, is positioned within the bore 56. The sealing ball 58 is sized such that it can move freely within the bore 56, but cannot pass through the narrow throat portion 54*a* thereof. A sealing spring 60 is positioned within the bore 56 to urge the sealing ball 58 against the narrow throat 54*a* to form a seal and prevent the flow of ink through the fluid outlet. A retaining ball 62, made of stainless steel in the illustrated embodiment, is press fit into the top of the bore to retain the sealing spring 60 in place. The bore 56 is configured to allow the free flow of ink past the retaining ball 62 and into the bore 56**.

A raised manifold 64 is formed on the top of the chassis 16. The manifold 64 forms a cylindrical boss around the top of the fill port 32 and a similar boss around the top of the inlet port 38 so that each of these ports is isolated. The manifold 64 extends around the base of the fluid outlet 20 and the outlet port 40 to form an open-topped conduit 66 joining the two outlets.

The flexible ink pouch 14 is attached to the top of the manifold 64 so as to form a top cover for the conduit 66. In the illustrated embodiment, this is accomplished by heat staking a rectangular plastic sheet 68 to the top surface of the manifold 64 to enclose the conduit 66. In the illustrated embodiment, the chassis 16 molded of high density polyethylene and the plastic sheet is low density polyethylene that is 0.002 inches thick. These two materials can be easily heat staked to one another using conventional methods and are also readily recyclable.

After the plastic sheet 68 is attached to the chassis 16, the sheet is folded and sealed around its two sides and top to form the flexible ink pouch 14. Again, in the illustrated embodiment, heat staking can be used to seal the perimeter of the flexible pouch 14. The plastic sheet over the fill port 32 and over the inlet port 38 can be punctured, pierced, or otherwise removed so as not to block the flow of ink through these ports.

Although the flexible pouch 14 provides an ideal way to contain ink, it may be easily punctured or ruptured and allows a relatively high amount of water loss from the ink. Accordingly, to protect the pouch 14 and to limit water loss, the pouch 14 is enclosed within the protective shell 12. In the illustrated embodiment, the shell 12 is made of clarified polypropylene, which is sufficiently translucent to permit inspection of the ink within the pouch 14 to determine that an adequate volume of ink remains for proper operation of the printer. A thickness of about one millimeter has been found to provide robust protection and to prevent unacceptable water loss from the ink. However, the material and thickness of the shell may vary in other embodiments.

The top of the shell 12 has a number of raised ribs 70 to facilitate gripping of the shell 12 as it is inserted in or withdrawn from the docking bay. A vertical rib 72 projects laterally from each side of the shell 12. The vertical rib 72 can be received within a slot (not shown) in the docking bay to provide lateral support and stability to the ink supply when it is positioned within the printer. The bottom of the shell 12 is provided with two circumferential grooves or recesses 76 which engage two circumferential ribs or beads 78 formed on a depending perimetrical wall 79 of the chassis 16 to attach the shell 12 to the chassis 16 in a snap fit.

The attachment between the shell 12 and the chassis 16 should, preferably, be snug enough to prevent accidental separation of the chassis from the shell and to resist the flow of ink from the shell should the flexible reservoir develop a leak. However, it is also desirable that the attachment not form a hermetic seal to allow the slow ingress of air into the shell as ink is depleted from the reservoir 14 to maintain the pressure inside the shell generally the same as the ambient pressure. Otherwise, a negative pressure may develop inside the shell and inhibit the flow of ink from the reservoir. The ingress of air should be limited, however, in order to maintain a high humidity within the shell and minimize water loss from the ink.

In the illustrated embodiment, the shell 12 and the flexible pouch 14 which it contains have the capacity to hold approximately thirty cubic centimeters of ink. The shell is approximately 67 millimeters wide, 15 millimeters thick, and 60 millimeters high. The flexible pouch 14 is sized so as to fill the shell without undue excess material. Of course, other dimensions and shapes can also be used depending on the particular needs of a given printer.

To fill the device 10, ink can be injected through the fill port 32. As it is filled, the flexible pouch 14 expands so as to substantially fill the shell 12. As ink is being introduced into the pouch, the sealing ball 58 can be depressed to open the fluid outlet and a partial vacuum can be applied to the fluid outlet 20. The partial vacuum at the fluid outlet causes ink from the pouch 14 to fill the chamber 36, the conduit 66, and the bore of the cylindrical boss 54 such that little, if any, air remains in contact with the ink. The partial vacuum applied to the fluid outlet also speeds the filling process. To further facilitate the rapid filling of the pouch, an exhaust port 34 is provided to allow the escape of air from the shell as the reservoir expands. Once the ink supply is filled, a ball 35 is press fit into the fill port 32 to prevent the escape of ink or the entry of air.

Of course, there are a variety of other ways which can also be used to fill the present ink containment and dispensing device. In some instances, it may be desirable to flush the entire device with carbon dioxide prior to filling it with ink. In this way. any gas trapped within the device during the filling process will be carbon dioxide, not air. This may be preferable because carbon dioxide may dissolve in some inks while air may not. In general, it is preferable to remove as much gas from the device as possible so that bubbles and the like do not enter the print head or the trailing tube.

The protective cap 22 is placed on the device 10 after the reservoir is filled. The protective cap is provided with a groove 80 which receives a rib 82 on the chassis to attach the cap to the chassis. The cap 22 carries a plug 84 which plugs the exhaust port 34 to limit the flow of air into the chassis and reduce water loss from the ink. A stud 86 extends from each end of the chassis 16 and is received within an aperture in the cap 22 to aid in aligning the cap and to strengthen the union between the cap and the chassis. The free ends of the studs 86, which extend beyond the apertures of the cap 22, are preferably deformed after the cap 22 is in place, for example, by contacting them with a heated tool, to provide a tamper resistant attachment of the cap 22 to the chassis 16. Further, the label 24 is glued to the sides of the device 10 to hold the shell 12, chassis 16, and cap 22 firmly together. In the illustrated embodiment, a hot-melt pressure sensitive or other adhesive is used to adhere the label in a manner that prevents the label from being peeled off and inhibits tampering with the ink supply.

The cap 22 in the illustrated embodiment is provided with a vertical rib 90 protruding from each side. The rib 90 is an extension of the vertical rib 72 on the shell and is received within the slot provided in the docking bay in a manner similar to the vertical rib 72. In addition to the rib 90, the cap 22 has protruding keys 92 located on each side of the rib 90. One or more of the keys 92 can be optionally deleted or altered so as to provide a unique identification of the particular ink supply by color or type. Mating keys (not shown), identifying a particular type or color of ink supply can be formed in the docking bay. In this manner, a user cannot inadvertently insert an ink supply of the wrong type or color into a docking bay. This arrangement is particularly advantageous for a multi-color printer where there are adjacent docking bays for ink supplies of various colors.

Figure 10:
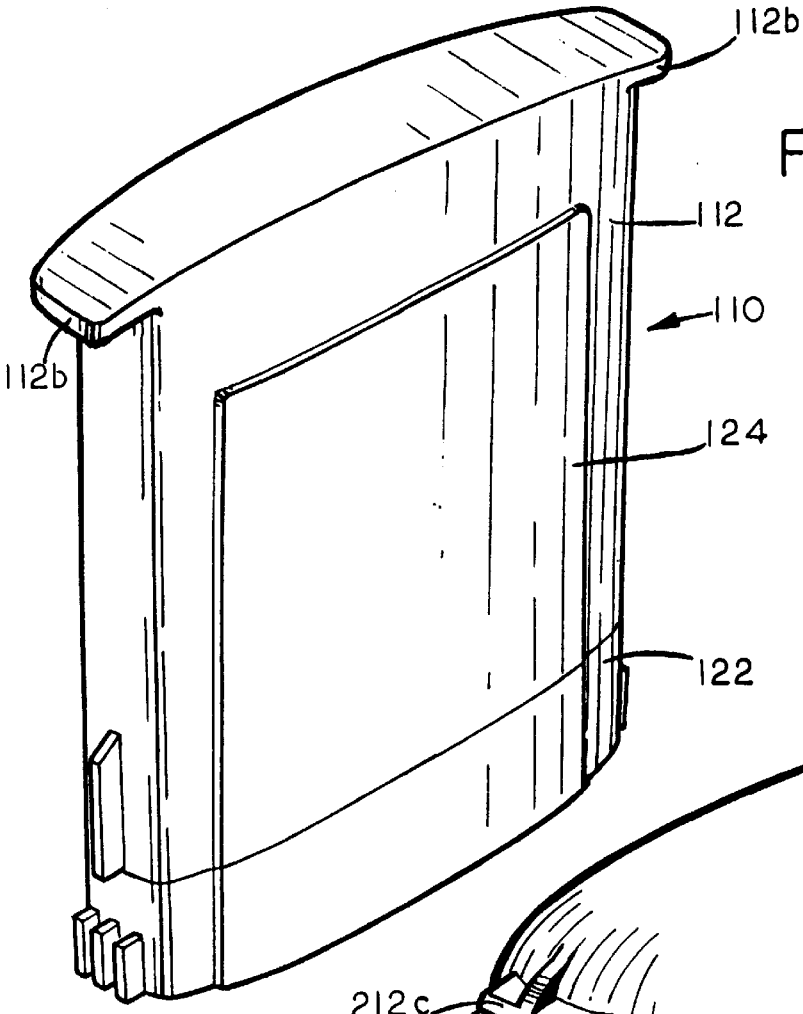
FIGS. 10 and 11 are perspective views showing alternative embodiments of a liquid containment and dispensing device according to the present invention.

In the embodiment of FIG. 10, elements that correspond to the elements of the embodiment of FIGS. 1–9 are identified by a 100 series numeral, the last two digits of which correspond to the two digits of the corresponding element of the embodiment of FIGS. 1–9.

The ink containment and dispensing device of FIG. 10 is generally identified by the reference numeral 110 and, except as hereinafter described, corresponds to the device 10 of FIGS. 1–9. The device 110 has a hard protective shell 112 that is open at one end, and the open end 112 is normally closed by a protective cap 122. A label 124 is glued to the sides of the device 110 to hold the shell 112 and the cap 122 firmly together. Preferably, a hot-melt pressure sensitive or other adhesive is used to adhere the label 124 to the shell 112 and the cap 122 in a manner that prevents the label 124 from being peeled off and inhibits tampering with the ink supply within the device 110.

The end of the shell 112 that is away from the end that is closed by the cap 122 is the end that is at the top of the device 110 when the device 110 is properly oriented to be inserted in a docking bay of an associated ink-jet printer (not shown). To make the proper orientation of the device 110 abundantly clear to a person installing a device 110 in a printer, the shell is provided with an opposed pair of outwardly projecting tabs 112*a*, 112*b* along the shorter pair of its sides. The tabs 112*a*, 112*b* serve to assist such a person in grasping a device 110 for insertion of a device 110 in a printer or for the removal of an empty device 110 from the printer, and naturally indicate the proper orientation of the device 110 at the time of its insertion into the printer. The shell 112 of the device 110 may be relatively inexpensively molded from a suitable thermoplastic material in a mold of simple design.

Figure 11:
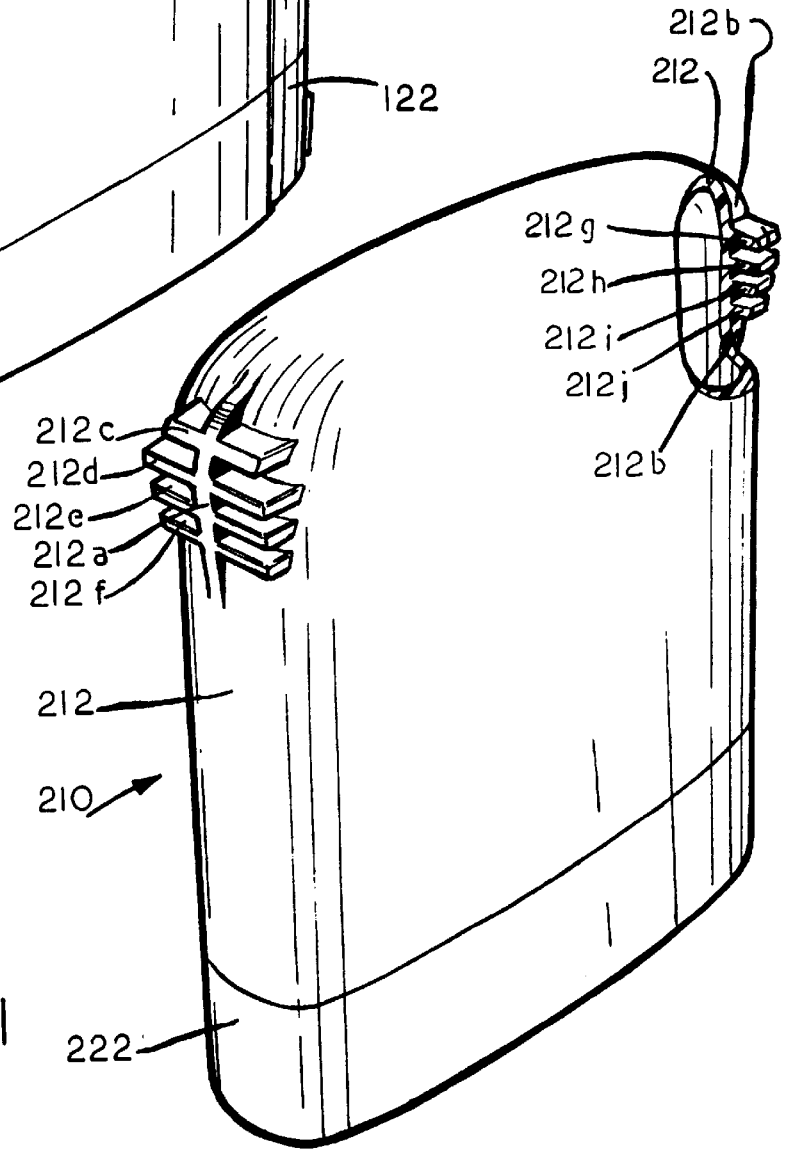

In the embodiment of the invention illustrated in FIG. 11, elements corresponding to the elements of the embodiment of FIGS. 1–9 are identified by a 200 series numeral, the last two digits which are the digits of the corresponding element of the invention of FIGS. 1–9.

The ink containment and dispensing device of FIG. 11 is generally identified by reference numeral 210, and except as hereinafter described, corresponds to the device 10 of FIGS. 1–9. The device 210 has a hard protective shell 212 that is open at one end and the open end of the shell 212 is closed by a protective cap 222.

The end of the shell 212 that is away from the end that is closed by the cap 222 is the end that is at the top of the device 210 when the device 210 is ready for insertion in a docking bay of an associated ink-jet printer (not shown). To make the proper orientation of the device 210 abundantly clear to a person installing the device 210 in a printer, the shell 212 is provided with an opposed pair of longitudinally extending, outwardly projecting ribs 212*a*, 212*b* along the shorter pair of its sides. The shell 212 is also provided with a spaced apart plurality of transversely extending ribs 212*c*, 212*d*, 212*e*, 212*f* that intersect the longitudinally extending rib 212*a*; likewise the shell 212 is provided with a spaced apart plurality of transversely extending ribs 212*g*, 212*h*, 212*i*, 212*j* that intersect the longitudinally extending rib 212*b*.

The ribs 212*a*, 212*b*, with their associated transversely extending ribs 212*c*, 212*d*, 212*e*, 212*f*, 212*g*, 212*h*, 212*i*, 212*j*, serve to very positively assist a person grasping a device 210 for insertion of the device 210 into a printer, or for removal of an empty device 210 from the printer, and naturally indicate the proper orientation of the device 210 at the time of its insertion into the printer. The shell 212 of the device 210 may be manufactured in its illustrated complex configuration from a suitable thermoplastic material by molding.

Figure 12:
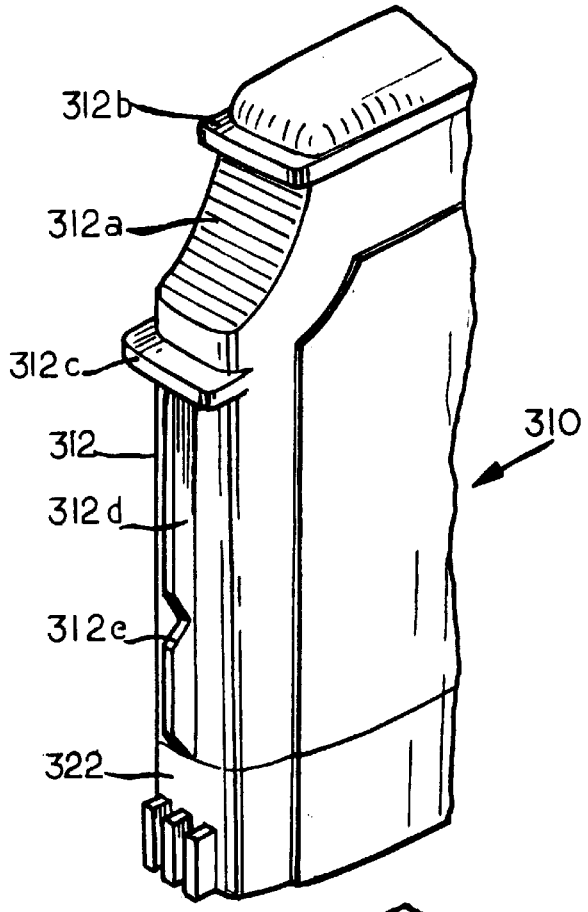
FIGS. 12 and 13 are fragmentary perspective views showing further alternative embodiments of a liquid containment and dispensing device according to the present invention.

In the embodiment of the invention illustrated in FIG. 12, elements corresponding to the elements of FIGS. 1–9 are identified by a 300 series numeral, the last two digits of which are the two digits of the corresponding element of the invention of FIGS. 1–9.

The ink containment and dispensing device of FIG. 12 is generally identified by reference numeral 310 and, except as hereinafter described, corresponds to the device 10 of FIGS. 1–9. The device 310 has a hard protective shell 312 that is open at one end, and the open end of the shell 312 is closed by a protective cap 322. A label 324 is glued to the sides of the device 310 to hold the shell 312 and cap 322 firmly together. In the illustrated embodiment, a hot-melt pressure sensitive or other adhesive is used to adhere the label 324 to the shell 312 and the cap 322 in a manner that prevents the label from being peeled off and inhibits tampering with the ink supply.

The shell 312 has an opposed pair of shorter sides interspersed with an opposed pair of longer sides and each of its shorter sides tapers inwardly near the closed end of the shell 312, as is illustrated at 312*a*, to provide a gripping surface for the fingers of a user involved in installing the device 310 in a printer. Further, the shell 312 is provided with a radially outwardly projecting flange 312*b* above the level of the tapered portion 312*a* to further assist a user in grasping the device 310 at the tapered portion 312*a* and an opposed tapered portion, not shown.

Each of the opposed shorter sides of the shell 312 is also provided with an outwardly projecting flange, for example the flange 312*c*, below the level of the tapered portion 312*a*. The purpose of the flange 312*c* is to inhibit insertion of the device 310 into the docking bay of a printer in an inverted orientation of the device 310.

Each of the opposed shorter sides of the shell 312 is also provided with an outwardly projecting and longitudinally extending rib 312*d*. The purpose of the rib 312*d* is to assist in the insertion of the device 310 into the docking bay of a printer, and the rib 312*d* is provided with an eccentrically positioned notch 312*e* to positively lock the device 310 into the docking bay of the printer. The shell 312 may be manufactured in its illustrated, complex configuration from a suitable thermoplastic material by molding.

Figure 13:
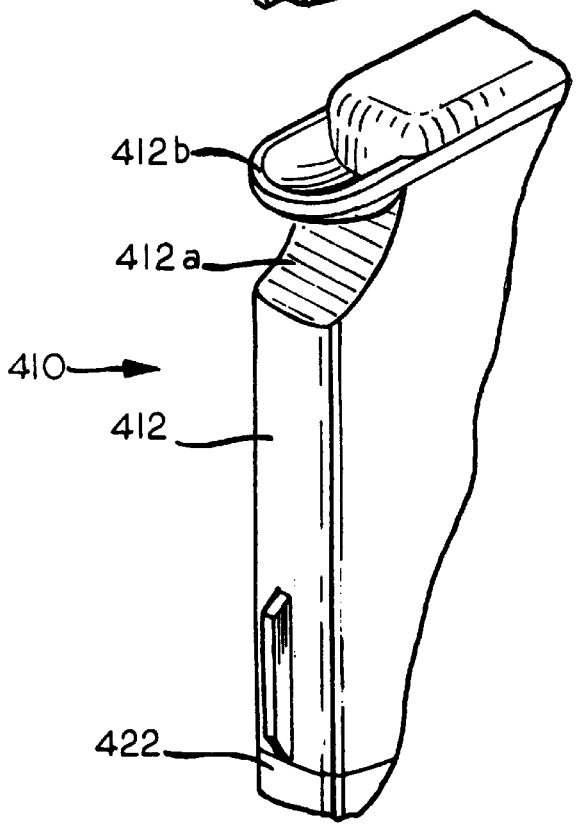

In the embodiment of the invention illustrated in FIG. 13, elements corresponding to the elements of FIGS. 1–9 are identified by a 400 series numeral, the last two digits of which are the two digits of the corresponding element of the invention of FIGS. 1–9.

The ink containment and dispensing device of FIG. 13 is generally identified by reference numeral 410 and, except as hereinafter described, corresponds to the device 10 of FIGS. 1–9. The device 410 has a hard protective shell 412, which is open at one end, and the open end of the shell 412 is closed by a protective cap 422.

The shell 412 has an opposed pair of shorter sides interspersed with an opposed pair of longer sides, and each of the shorter sides has an inwardly tapered finger gripping portion near the upper end thereof, in the illustrated orientation of the device 410, the inwardly tapered portion illustrated in FIG. 13 being identified by reference numeral 412*a*. The inwardly tapered portions of the shell 412, including the portion 412*a*, provide a location to be gripped by the fingers of the person installing the device 410 into, or removing the device 410 from, a docking bay of an ink-jet printer.

Each of the opposed shorter sides of the shell 412 of the device 410 is further provided with an outwardly projecting tab above the level of the tapered portion, such as the tab 412*b* which is positioned above the tapered portion 412*a* of the shell 412. Each of the tabs, such as the tab 412*b*, is concave in an upwardly facing direction and serves to prevent the device 410 from being inserted into the docking bay of a printer in an inverted orientation.

The shell 412 of the device 410 may be manufactured in its illustrated complex configuration from a suitable thermoplastic material by molding.

The liquid containment and dispensing device of the various embodiments of the present invention has been specifically described as a device for containing and dispensing a supply of printing ink in an ink-jet printer as the preferred embodiment of the invention. However, it is also contemplated that the present invention can easily be adapted to the containment and dispensing of other Newtonian (low viscosity) liquids.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. A liquid containment and dispensing device for insertion into an ink jet printer and having a rigid, generally cup-shaped outer shell with an open end at a first location and a closed end at a second location, and a protective cap secured to the open end of the shell, the improvement wherein the outer shell has means on an outer surface thereof only at a third location adjacent the closed end of the shell for identifying the second location of the closed end of the shell to thereby help to prevent improper insertion of the liquid containment and dispensing device into the printer; wherein the shell has an opposed pair of shorter sides interspersed with an opposed pair of longer sides, and wherein said means for identifying the second location comprises an outwardly projecting tab on each of the shorter sides at the second location.

2. A liquid containment and dispensing device for insertion into an ink jet printer and having a rigid, generally cup-shaped outer shell with an open end at a first location and a closed end at a second location, and a protective cap secured to the open end of the shell, the improvement wherein the outer shell has means on an outer surface thereof only at a third location adjacent the closed end of the shell for identifying the second location of the closed end of the shell to thereby help to prevent improper insertion of the liquid containment and dispensing device into the printer; wherein the shell has an opposed pair of shorter sides interspersed with an opposed pair of longer sides, and wherein said means for identifying the second location comprises:

a longitudinally extending rib along each of the opposed pair of shorter sides at the third location; and a spaced apart plurality of transversely extending ribs intersecting the longitudinally extending rib on each of the opposed pair of shorter sides of the shell.

3. A liquid containment and dispensing device for insertion into an ink jet printer and having a rigid, generally cup-shaped outer shell with an open end at a first location and a closed end at a second location, and a protective cap secured to the open end of the shell, the improvement wherein the outer shell has means on an outer surface thereof only at a third location adjacent the closed end of the shell for identifying the second location of the closed end of the shell to thereby help to prevent improper insertion of the liquid containment and dispensing device into the printer; wherein the shell has an opposed pair of shorter sides interspersed with an opposed pair of longer sides, and wherein said means for identifying the second location comprises:

a tapered portion along each of the opposed pair of shorter sides tapering outwardly from the third location;

a first flange, said first flange projecting outwardly from the shell at a location external to the tapered portion; and a second flange, said second flange projecting outwardly from each of the opposed pair of shorter sides at a location beyond the tapered portion.

4. A device according to claim 3 and further comprising:

a longitudinally extending rib on each of the opposed pair of shorter sides positioned away from the flange.

5. A liquid containment and dispensing device for insertion into an ink jet printer and having a rigid, generally cup-shaped outershell with an open end at a first location and a closed end at a second location, and a protective cap secured to the open end of the shell, the improvement wherein the outer shell has means on an outer surface thereof only at a third location adjacent the closed end of the shell for identifying the second location of the closed end of the shell to thereby help to prevent improper insertion of the liquid containment and dispensing device into the printer; wherein the shell has an opposed pair of shorter sides interspersed with an opposed pair of longer sides, and wherein said means for identifying the second location comprises:

a tapered portion on each of said opposed pair of shorter sides, said tapered portion tapering outwardly from the third location; and a tab projecting outwardly from said shell above each tapered portion of each of the opposed sides of said shell.

6. A device according to claim 5 wherein each tab has an outwardly facing concave configuration.

7. A method of facilitating proper orientation of a liquid containment and dispensing device when the device is to be inserted into a receiving unit, the device having a generally cup-shaped outer shell with a sidewall, an open end and a closed end and a protective cap secured to the open end of the shell, said method comprising:

providing the outer shell with opposed, outwardly projecting means only at a location adjacent of the closed end of the shell for identifying the location of the closed end of the shell to thereby help to prevent improper insertion of the liquid containment and dispensing device into the receiving unit, wherein the outer shell has an opposed pair of shorter sides interspersed with an opposed pair of longer sides, and wherein the opposed pair of shorter sides is provided with the opposed, outwardly projecting means.

* * * * *

UNITED STATES PATENT AND TRADEMARK OFFICE
CERTIFICATE OF CORRECTION

PATENT NO 6,068,371

DATED May 30, 2000

INVENTOR(S) Wallace et al.

It is certified that error appears in the above-identified patent and that said Letters Patent are hereby corrected as shown below:

On Title page, Item 73, change "Assignee: Owens-Illinois Closure Inc., Toleod, Ohio" to "Owens-Illinois Closure Inc., Toledo, Ohio and Hewlett-Packard Company, Corvallis, Oregon".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*